US005678806A

United States Patent [19]

Hille et al.

[11] Patent Number: 5,678,806

[45] Date of Patent: Oct. 21, 1997

[54] PLATE COOLERS FOR SHAFT FURNACES

[75] Inventors: Hartmut Hille, Moers-Schwafheim; Werner Otremba, Oberhausen, both of Germany

[73] Assignee: MAN Gutehoffnungshütte Aktiengesellschaft, Oberhausen, Germany

[21] Appl. No.: 642,626

[22] Filed: May 3, 1996

[30] Foreign Application Priority Data

May 5, 1995 [DE] Germany ..... 195 16 535.7
Dec. 2, 1995 [DE] Germany ..... 195 45 048.5

[51] Int. Cl.[6] ..... C21B 7/10

[52] U.S. Cl. ..... 266/193

[58] Field of Search ..... 266/193, 194, 266/190; 122/6 A, 6 B

[56] References Cited

U.S. PATENT DOCUMENTS

| | | | |
|---|---|---|---|
| 1,039,282 | 9/1912 | Hicks | 266/193 |
| 1,090,574 | 3/1914 | Shannon | 266/193 |
| 4,327,900 | 5/1982 | Engel et al. | 266/193 |

FOREIGN PATENT DOCUMENTS

| | | | |
|---|---|---|---|
| 9411 5821.4 | 4/1996 | European Pat. Off. . | |
| 29 07 511 | 9/1980 | Germany . | |
| 195 03 912.2 | 2/1995 | Germany . | |
| 1581747 | 7/1990 | Russian Federation | 266/193 |

*Primary Examiner*—Scott Kastler
*Attorney, Agent, or Firm*—McGlew and Tuttle

[57] ABSTRACT

Plate coolers including a plate cooler made of copper or a low-alloy copper alloy for shaft furnaces, especially blast furnaces, with blind holes arranged in the cooling body for passing through cooling water, as well as with vertical side flanges arranged around the cooling body and with horizontal side flanges. The plate cooler can be connected to another plate cooler to form a plate cooler segment or plate cooler ring. Webs and grooves located between them are arranged in the plate cooler in the area of the cooling body on a side facing the interior of the furnace for holding refractory material.

14 Claims, 5 Drawing Sheets

*Fig. 3*
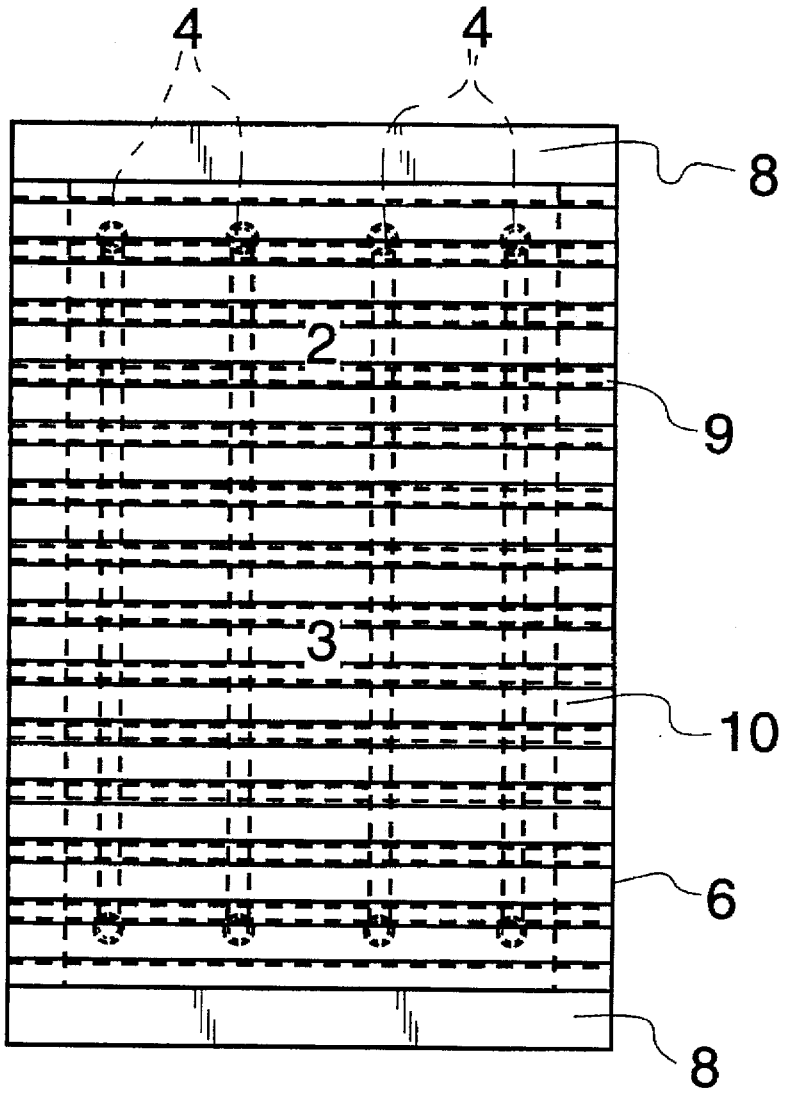
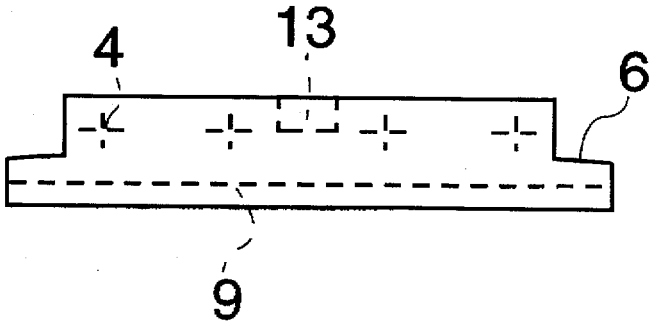
*Fig. 4*

PLATE COOLERS FOR SHAFT FURNACES

FIELD OF THE INVENTION

The present invention pertains to plate coolers for shaft furnaces provided with a refractory lining, especially for blast furnaces, consisting of copper or a low-alloy copper alloy, with coolant channels arranged in their interior, wherein the plate cooler is made of a forged or rough rolled ingot, the cooling channels are vertically extending blind holes, with additional vertical and horizontal blind holes of smaller diameter arranged at the edge in the plate cooler if needed, or with a cooling segment arranged on the plate cooler with vertically extending blind holes, which are connected at their ends to horizontally extending blind holes.

BACKGROUND OF THE INVENTION

Such copper plate coolers are usually arranged between the furnace shell and the furnace lining and are connected to the cooling system of the shaft furnace. On the side facing the interior of the furnace, the cooling elements are extensively provided with refractory material.

Plates made of a copper casting, in which the cooling channels are formed either by cast-in steel tubes or are cast in directly, have been known. The structure of a copper casting is not as homogeneous and dense as that of forged or rolled copper. The thermal conduction of a copper casting is consequently also poorer and its strength is lower. An oxide film between the tube and the copper ingot hinders thermal conduction in cast-in tubes.

A plate cooler which is made of a forged or rough rolled ingot and in which the cooling channels are vertically extending blind holes provided by mechanical deep drilling has been known from DE 29 07 511. The structure of the plate cooler is substantially denser and more homogeneous than that of a east copper plate; blowholes, which frequently occur in cast copper plates, are ruled out. The strength values are higher than those of the cast copper plates. The desired length of the holes in the vertical and lateral directions is closely complied with, and a uniform removal of heat is guaranteed as a result.

On the side facing the interior of the furnace, the plate cooler is provided with webs and grooves and may be lined with refractory bricks or with a refractory tamping clay. The cooling surface of the plate is reduced by this, and the absorption of heat from the furnace is limited in the case of wear or loss of the refractory furnace lining. The cooling of the plate should be so intense that the temperature of the hot side of the plate is maintained far below the softening point of copper.

The yet unpublished EP 94 11 5821.4 discloses a plate cooler made of forged or rolled copper tube ingot, in which cooling channels, which are introduced into the edges as vertical or horizontal blind holes of a smaller diameter around the vertically arranged blind holes, are provided for cooling the peripheral zones in addition to the vertically extending blind holes.

The yet unpublished DE Patent Application No. P 195 03 912.2 discloses a plate cooler manufactured from a forged or rolled copper tube ingot, in which an additional cooling element is arranged, detachably or forged together, in the upper or lower area in addition to the vertically extending blind holes, and vertical and horizontal blind holes are additionally introduced into the said additional cooling element, and the latter blind holes are also connected to the cooling system of the blast furnace via copper connecting branches.

However, it is disadvantageous in connection with the arrangement and the fastening of these rolled copper plates on the furnace shell that a vertical gap, which must be filled with refractory material or with specially cut carbon bricks, is formed between the individual plate coolers. The installation of this cooling system is time-consuming and expensive.

SUMMARY AND OBJECTS OF THE INVENTION

The object of the present invention is therefore to provide a cooling system consisting of copper plate coolers in which copper plate coolers arranged vertically next to each other or horizontally one on top of another are arranged so densely in the interior of a shaft furnace that the heat is removed uniformly even in the transition of the plate coolers, so that cooling of the refractory furnace lining and of the furnace shell is guaranteed there as well.

According to the invention, plate coolers are provided for shaft furnaces with a refractory lining, especially for blast furnaces. The plate coolers are made of copper or a low-allow copper alloy with coolant channels arranged in their interior. The plate coolers are made of a forged or rough rolled ingot, the cooling channels are vertically extending blind holes and, if necessary, with additional vertical and horizontal blind holes of a smaller diameter arranged at the edge in the plate cooler, or with a cooling segment arranged on the plate cooler with vertically extending blind holes, which are connected at their ends to horizontally extending blind holes. One plate cooler is provided with bilateral, vertical side flanges and with bilateral, horizontal side flanges, with horizontally arranged webs and grooves facing the interior of the furnace on the cooling body between the side flanges. Another plate cooler is provided with bilateral, vertical side flanges and with bilateral, horizontal side flanges, with horizontally arranged webs and grooves facing the interior of the furnace on the said cooling body and on the side flanges.

According to another embodiment of the invention, plate coolers are provided for shaft furnaces with a refractory lining, especially for blast furnaces. The plate coolers are made of copper or a low-alloy copper alloy with coolant channels arranged in their interior. Each plate cooler is made of a forged or rough rolled ingot, the cooling channels are vertically extending blind holes, if necessary, with additional vertical and horizontal blind holes of a smaller diameter at the edge in the plate cooler or with a cooling segment arranged on the plate cooler with vertically extending blind holes, which are each connected at their ends to horizontally extending blind holes. One plate cooler is provided with bilateral, vertically extending side flanges or with bilateral, horizontal side flanges, with horizontally arranged webs and grooves facing the interior of the furnace on the cooling body between the side flanges. Another plate cooler is provided with bilateral, vertical side flanges or with bilateral, horizontal side flanges, with horizontally arranged webs and grooves facing the interior of the furnace on the said cooling body and on the side flanges.

Threaded holes are preferably provided in the vertical side flanges or in the horizontal side flanges. Holes are preferably provided in the vertical side flanges or in the horizontal side flanges.

The two vertical side flanges are preferably overlappingly connected to one another by fasteners which are led through the holes and are screwed into the threaded holes with high-temperature sealing washers.

The invention preferably provides cooling segments comprising one said one plate cooler each with two said another plate cooler or two said one plate cooler and one said another plate cooler. The invention further provides a circular cooling ring formed of a plurality of said one plate coolers and of said another plate coolers. The cooling segment or circular cooling ring is provided within the blast furnace shell.

The plate coolers may be provided in the known manner with openings for suspending lifting lugs fastened to the furnace shell.

The two horizontal side flanges are preferably overlappingly connected to one another by fasteners. The fasteners are led through the holes and are screwed into the threaded holes with high-temperature sealing washers. Either vertical and horizontal side flanges extending on both sides, or only vertical side flanges, which, arranged overlapped, form a continuous cooling system, are therefore provided according to the present invention on the cooling body of the forged or rolled copper plate cooler, which cooling body is provided with inner blind holes.

At least three plate coolers are needed to form a horizontal cooling segment; a plurality of plate coolers are needed to form a complete horizontal cooling ring within the furnace shell, and at least two plate coolers are needed to form a limited cooling surface.

Two different types of plate coolers, in which the webs and grooves on the cooling body must face the interior of the blast furnace to accommodate refractory material, are necessary due to the overlapping connection of the vertical side flanges of the cooling elements.

One of the two plate coolers according to a first embodiment of the invention is therefore provided with bilateral, vertical and horizontal side flanges and with horizontally arranged webs and grooves facing the interior of the furnace on the cooling body between the side flanges. The other plate cooler is likewise provided with bilateral, vertical and horizontal side flanges and with horizontally arranged webs and grooves facing the interior of the furnace on the cooling body and on the side flanges.

One of the two plate coolers according to the second embodiment of the invention is provided only with bilateral, vertical side flanges and with horizontally arranged webs and grooves facing the interior of the furnace on the cooling body between the side flanges. The other plate cooler is likewise provided with bilateral, vertical side flanges and with horizontally arranged webs and grooves facing the interior of the furnace on the cooling body and on the side flanges.

If a plurality of layers of horizontal cooling segments or complete cooling rings are to be arranged one on top of another in the interior of a blast furnace, these are designed as overlapping layers due to the horizontal side flanges of the plate coolers.

Horizontal cooling segments or complete cooling rings may also be formed one on top of another in the interior of a blast furnace with plate coolers without horizontal side flanges. However, the cooling segments or complete cooling rings are laid butt-joined in this case.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a longitudinal sectional view through another plate cooler;

FIG. 4 is a cross sectional view through the plate cooler of FIG. 3;

DESCRIPTION OF THE PREFERRED EMBODIMENTS

Figure 1:
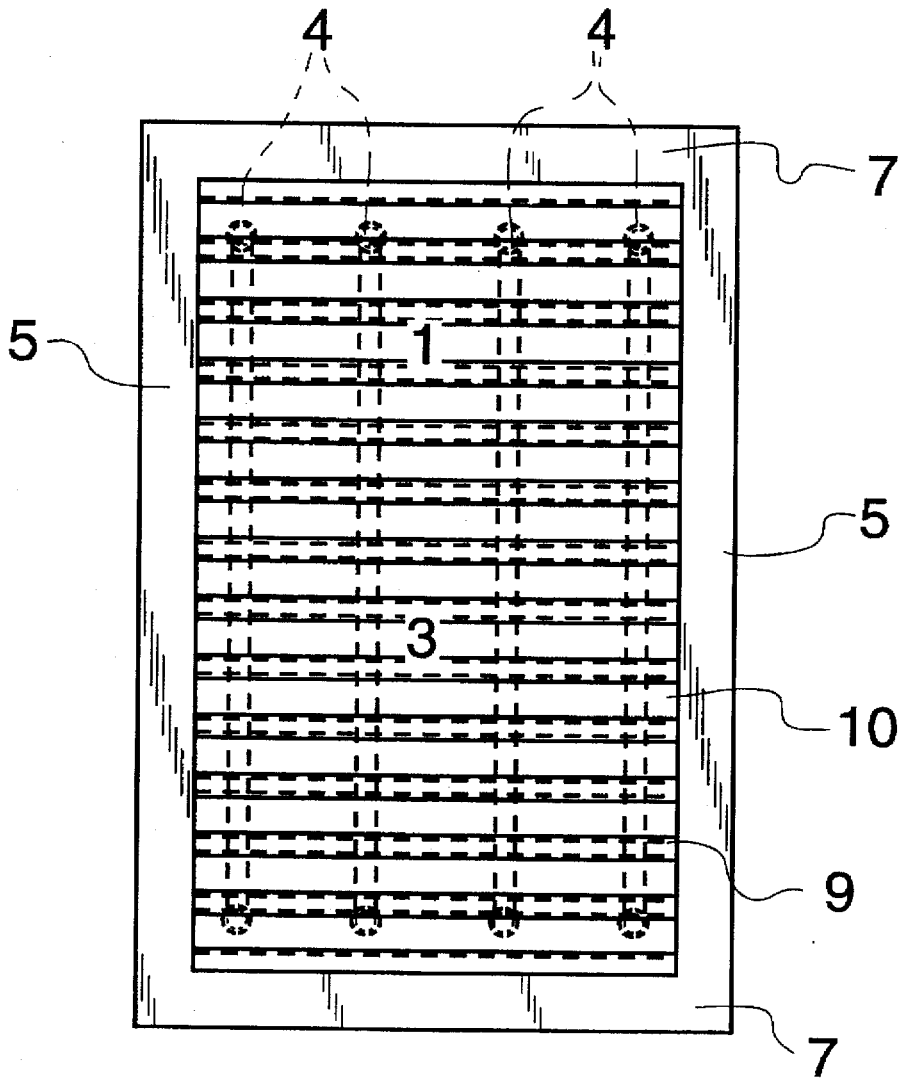
FIG. 1 is a longitudinal sectional view through a plate cooler.
Figure 2:
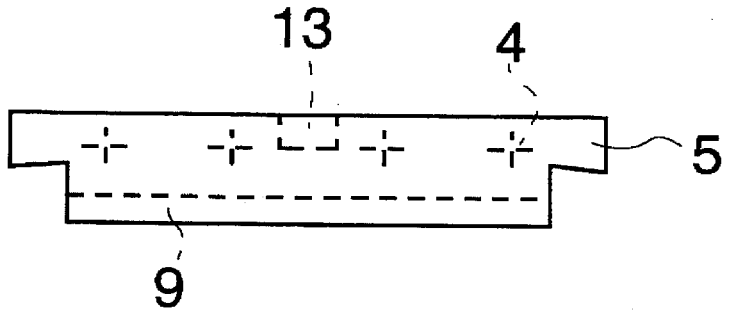
FIG. 2 is a cross sectional view through the plate cooler of FIG. 1.

FIGS. 1 and 2 show a longitudinal section and a cross section of a plate cooler 1 (also referred to herein as a plate cooler of a first type), respectively. The webs 9 and grooves 10 are limited to the cooling body 3 only, in which the vertically extending blind holes 4 for the cooling water are also provided.

Vertical side flanges 5 are arranged to the side of the cooling body 3, and horizontal side flanges 7 are arranged above and under the cooling body. According to FIG. 2, an opening 13 for receiving a lifting lug arranged on the furnace wall is provided on the outside located opposite the webs 9 and grooves 10.

FIGS. 3 and 4 show a longitudinal section and a cross section of a plate cooler 2 (referred to herein also as a plate cooler of a second type), respectively, with horizontal side flanges 8. The webs 9 and grooves 10 are arranged on both the cooling body 3 and the vertical flanges 6 provided on the side, while the vertically extending blind holes 4 for the cooling water are limited to the cooling body 3. An opening 13 is provided according to FIG. 4 for receiving a lifting plug arranged on the furnace wall on the narrower outside located opposite the webs 9 and grooves 10.

Figure 5:
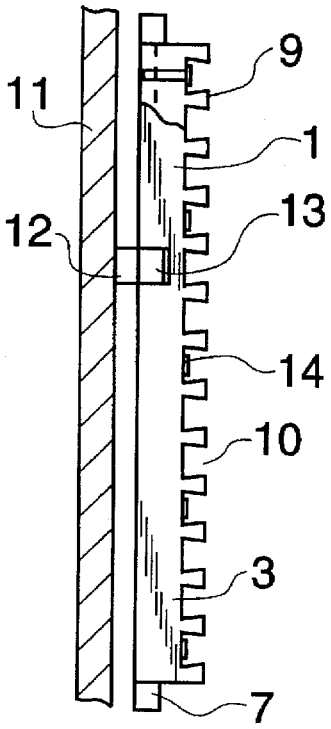
FIG. 5 is a side view of the plate cooler of FIG. 1.

FIG. 5 shows the side view of a plate cooler 1 with horizontal side flanges 7, which are provided on top and bottom and are arranged in the direction of the furnace shell 11. Webs 9 and grooves 10 are alternatingly arranged on the side of the cooling body 3 facing the interior of the furnace. The webs 9 and grooves 10 preferably have a dovetail design to provide a better hold to the refractory lining. On the side facing the blast furnace shell 11, the plate cooler has an opening 13, which is engaged by a lifting lug 12, which is welded to the blast furnace shell 11.

Figure 6:
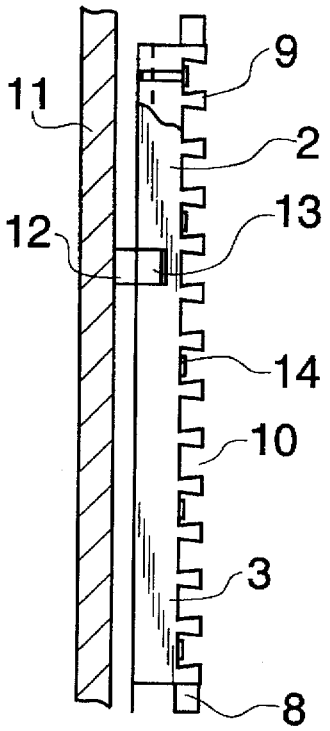
FIG. 6 is a side view of a plate cooler of FIG. 3.

FIG. 6 shows the side view of a plate cooler 2 with horizontal side flanges 8, which are provided on top and bottom and are arranged in the direction of the center of the furnace. The webs 9 and grooves 10 are arranged analogously to FIG. 5.

Figure 7:
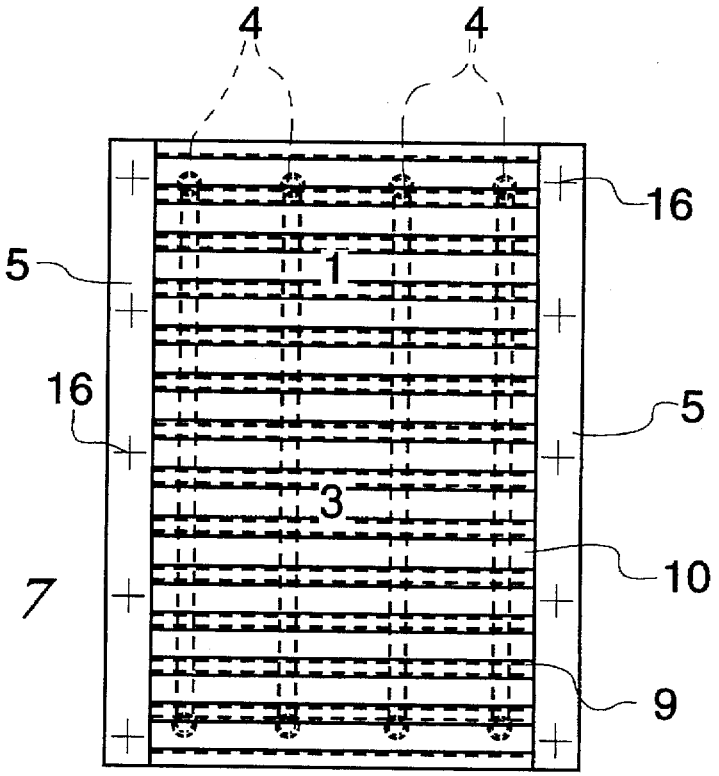
FIG. 7 is a longitudinal sectional view through a plate cooler of FIG. 1.

FIG. 7 shows the plate cooler 1 with only laterally arranged vertical flanges 5. The webs 9 and grooves 10 are limited to the cooling body 3 only, in which vertically extending blind holes 4 for the flow of cooling water are provided. Threaded holes 16 are provided in the flanges 5 to make it possible to establish a detachable connection by means of fasteners between a plate cooler 1 and a plate cooler 2 corresponding to FIG. 9.

Figure 8:
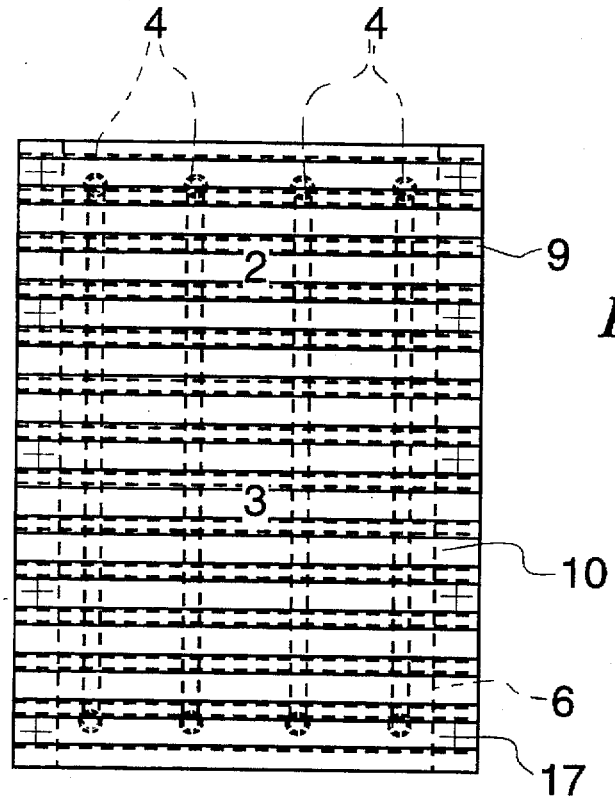
FIG. 8 is a longitudinal sectional view through a plate cooler of FIG. 3.

FIG. 8 shows the plate cooler 1 with only laterally arranged vertical flanges 6. The webs 9 and grooves 10 are arranged on both the cooling body 3 and the vertical flanges 6 provided on the side, while the vertically extending blind holes 4 for the cooling water are limited to the cooling body 3. Holes are provided in the flanges 6 in order to make it possible to establish a detachable connection by means of fasteners between a plate cooler 1 and a plate cooler 2 corresponding to FIG. 9.

Figure 9:
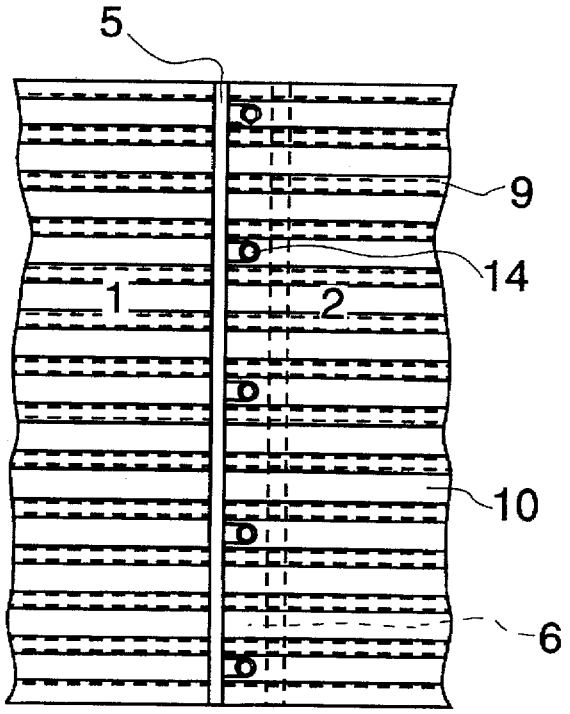
FIG. 9 is a longitudinal sectional view through two plate coolers connected to one another.

A longitudinal section of two plate coolers 1 and 2 connected to one another is shown in FIG. 9. The webs 9 and grooves 10 of both plate coolers 1 and 2 extend horizontally in the same plane. The fasteners 14 are introduced through holes arranged in the grooves 10 in the area of the two overlapping flanges 5 and 6.

Figure 10:
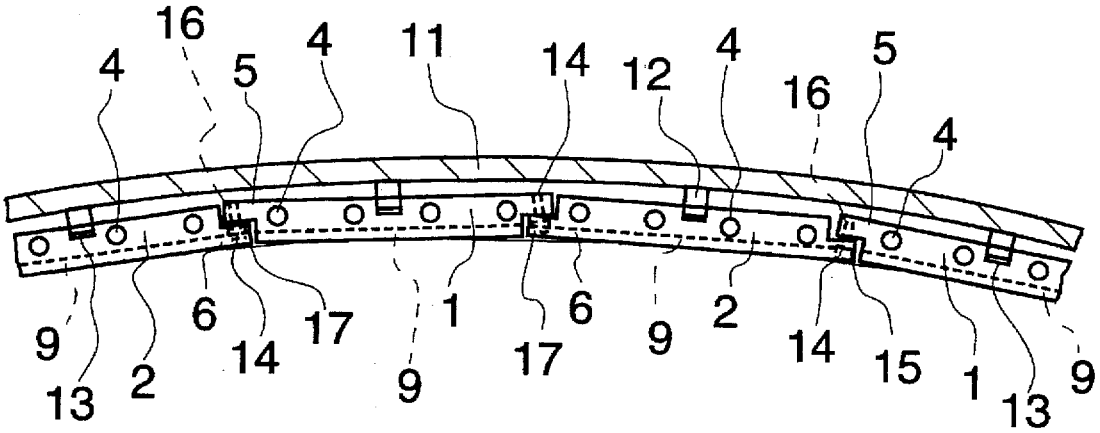
FIG. 10 is a top view of the arrangement of a cooling ring in a blast furnace.

FIG. 10 shows a top view of a detail of the arrangement of a cooling ring consisting of the plate coolers 1 and 2 within a blast furnace. The plate coolers 1 and 2 are suspended on the lifting lug 12 of the furnace shell 11 by means of openings 13, and the webs 9 of the plate coolers 1 and 2 face the interior of the furnace and are used to accommodate refractory material. The cooling water, which communicates with the cooling circuit of the blast furnace, is led through the blind holes 4 inside. The plate coolers 1 and 2 are detachably connected by means of fasteners 14 in the area of the overlapping flanges 5 and 6. A threaded hole 16 is provided in the flange 5 of the plate cooler 1, and a hole 17 is provided in the flange 6 of the plate cooler 2. A hexagon head screw, which is passed through the hole 8 and is screwed into the threaded hole 7, is usually used as the fastener 14. High-temperature sealing washers 15 are used to secure the fasteners 14.

While specific embodiments of the invention have been shown and described in detail to illustrate the application of the principles of the invention, it will be understood that the invention may be embodied otherwise without departing from such principles.

What is claimed is:

1. Plate coolers for shaft furnaces provided with a refractory lining, each of said plate coolers being formed of copper or a low-alloy copper alloy with coolant channels arranged in their interior, wherein each of said plate coolers is made of a forged or rough rolled ingot, the cooling channels being one of vertically extending blind holes, vertically extending blind holes with additional vertical and horizontal blind holes of a smaller diameter arranged at the edge in the plate cooler, and a cooling segment arranged on the plate cooler with vertically extending blind holes connected at their ends to horizontally extending blind holes, the plate coolers comprising:

a plate cooler of a first type with a cooling body portion and bilateral, vertical side flanges and with bilateral, horizontal side flanges, said plate cooler of a first type including horizontally arranged webs and grooves facing an interior of the furnace on said cooling body portion between said side flanges; and a plate cooler of a second type provided with a cooling body portion and bilateral, vertical side flanges and with bilateral, horizontal side flanges, said plate cooler of a second type including horizontally arranged webs and grooves facing the interior of the furnace on said cooling body portion of said plate cooler of a second type and on said side flanges of said plate cooler of a second type.

2. Plate coolers in accordance with claim 1, further comprising threaded holes provided in one of said vertical side flanges and said horizontal side flanges of said plate cooler of a first type, and holes provided in one of said vertical side flanges and said horizontal side flanges of said plate cooler of a second type.

3. Plate coolers in accordance with claim 2, further comprising fasteners overlappingly connecting one of said vertical side flanges of said plate cooler of a first type to one of said vertical side flanges of said plate cooler of a second type, said fasteners being led through said holes of said plate cooler of a second type and being screwed into said threaded holes of said plate cooler of a first type with high-temperature sealing washers.

4. Plate coolers in accordance with claim 1, wherein one said plate cooler of a first type each with two said plate coolers of a second type or two said plate coolers of a first type an one said plate cooler of a second type form one cooling segment within a blast furnace shell.

5. Plate coolers in accordance with claim 1, wherein a plurality of said plate coolers of a first type and a plurality of said plate coolers of a second type form a circular cooling ring within a blast furnace shell.

6. Plate coolers in accordance with claim 1, wherein said plate coolers are provided with openings for suspending said lifting lugs fastened to a furnace shell.

7. Plate coolers in accordance with claim 2, further comprising fasteners connecting one of said horizontal side flanges of said plate cooler of a first type overlappingly with one of said horizontal side flanges of said plate cooler of a second type, said fasteners being led through said holes and being screwed into said threaded holes with high-temperature sealing washers.

8. Plate coolers for shaft furnaces provided with a refractory lining, each of said plate coolers being formed of copper or a low-alloy copper alloy with coolant channels arranged in their interior, wherein each of said plate coolers is made of a forged or rough rolled ingot, the cooling channels being one of vertically extending blind holes, vertically extending blind holes with additional vertical and horizontal blind holes of a smaller diameter arranged at the edge in the plate cooler, and a cooling segment arranged on the plate cooler with vertically extending blind holes connected at their ends to horizontally extending blind holes, the plate coolers comprising:

a plate cooler of a first type with a cooling body portion and with one of bilateral, vertically extending side flanges and bilateral, horizontal side flanges, said plate cooler of a first type including horizontally arranged webs and grooves facing an interior of the furnace on said cooling body portion between said side flanges; and a plate cooler of a second type with a cooling body portion and with one of bilateral, vertical side flanges and bilateral, horizontal side flanges, said plate cooler of a first type including horizontally arranged webs and grooves facing the interior of the furnace on said cooling body portion of said plate cooler of a second type and on said side flanges of said plate cooler of a second type.

9. Plate coolers in accordance with claim 8, further comprising threaded holes provided in one of said vertical side flanges and said horizontal side flanges of said plate cooler of a first type, and holes provided in one of said vertical side flanges and said horizontal side flanges of said plate cooler of a second type.

10. Plate coolers in accordance with claim 9, fasteners overlappingly connecting one of said vertical side flanges of said plate cooler of a first type to one of said vertical side flanges of said plate cooler of a second type, said fasteners being led through said holes of said plate cooler of a second type and being screwed into said threaded holes of said plate cooler of a first type with high-temperature sealing washers.

11. Plate coolers in accordance with claim 8, wherein one said plate cooler of a first type each with two said plate coolers of a second type or two said plate coolers of a first type and one said plate cooler of a second type form one cooling segment within a blast furnace shell.

12. Plate coolers in accordance with claim 8, wherein a plurality of said plate coolers of a first type and a plurality of said plate coolers of a second type form a circular cooling ring within a blast furnace shell.

13. Plate coolers in accordance with claim 8, wherein said plate coolers are provided with openings for suspending said lifting lugs fastened to a furnace shell.

14. Plate coolers in accordance with claim 9, further comprising fasteners connecting one of said horizontal side flanges of said plate cooler of a first type overlappingly with one of said horizontal side flanges of said plate cooler of a second type, said fasteners being led through said holes and being screwed into said threaded holes with high-temperature sealing washers.

* * * * *